United States Patent [19]

Takao et al.

[11] Patent Number: 4,702,684

[45] Date of Patent: Oct. 27, 1987

[54] SLIDE VANE TYPE COMPRESSOR WITH INCREASED SUCTION PART-CROSS-SECTIONAL AREA

[75] Inventors: Kunihiko Takao; Kenichi Kawashima; Yozo Nakamura, all of Shimoinayoshi; Atsuo Kishi, Katsuta, all of Japan

[73] Assignee: Hitachi, Ltd., Tokyo, Japan

[21] Appl. No.: 891,045

[22] Filed: Jul. 30, 1986

Related U.S. Application Data

[63] Continuation of Ser. No. 694,052, Jan. 23, 1985, abandoned, which is a continuation of Ser. No. 432,804, Oct. 5, 1982, abandoned.

[30] Foreign Application Priority Data

Oct. 7, 1981 [JP] Japan ..... 56-158819

[51] Int. Cl.[4] ..... F04C 18/344

[52] U.S. Cl. ..... 418/259; 418/270

[58] Field of Search ..... 418/259, 150, 266–270

[56] References Cited

U.S. PATENT DOCUMENTS

| | | | |
|---|---|---|---|
| 1,395,916 | 11/1921 | Hayes | 418/259 |
| 2,899,940 | 8/1959 | Gibbs | 418/266 |
| 3,790,314 | 2/1974 | Swain | 418/268 |
| 3,809,511 | 5/1974 | Linder | 418/259 |
| 3,820,924 | 6/1974 | Cassidy | 418/267 |

FOREIGN PATENT DOCUMENTS

| | | | |
|---|---|---|---|
| 132086 | 7/1985 | Japan | 418/269 |
| 132087 | 7/1985 | Japan | 418/269 |

*Primary Examiner*—Carlton R. Croyle
*Assistant Examiner*—Jane E. Obee
*Attorney, Agent, or Firm*—Antonelli, Terry & Wands

[57] ABSTRACT

A slide vane type compressor comprises a cam ring formed with at least one working chamber and a rotor arranged in the at least one working chamber with an outer peripheral surface of the rotor being disposed close to an inner wall surface of the cam ring at least at one axial sealing portion thereof, with the rotor being formed vane grooves for respectively accommodating a plurality of vanes. At least one suction port introduces gas into the at least one working chamber, with the suction port having a suction terminal point angle extending from the axial sealing portion to a terminal point of the suction port, as viewed in the direction of rotation of the rotor. The suction terminal point angle of the suction port is greater than a geometrical suction terminal point angle geometrically determined in dependence upon the number of working chambers and the number of the plurality of vanes so that the suction terminal point angle of the suction port is advanced as compared with the geometrical suction terminal point angle.

13 Claims, 9 Drawing Figures

SLIDE VANE TYPE COMPRESSOR WITH INCREASED SUCTION PART-CROSS-SECTIONAL AREA

This application is a continuation of application Ser. No. 694,052, filed Jan. 23, 1985, which is a continuation of Ser. No. 432,804, filed Oct. 5, 1982, both now abandoned.

BACKGROUND OF THE INVENTION (1) Field of the Invention

This invention relates to a slide vane type compressor suitable for use with an air conditioning system for an automotive vehicle, a room air conditioning system, a freezer, etc.

(2) Description of the Prior Art

Slide vane type compressors are well known, as disclosed in U.S. Pat. Nos. 4,050,263 and 4,103,506, for example.

A slide vane type compressor generally comprises a cam ring with a space of the elliptic shape interposed between a front plate and a rear plate connected to opposite sides of the cam ring, a rotor formed with a plurality of vane grooves and located in the space of the cam ring and journalled at its shaft portion by bearings mounted in the front and rear plates, and a plurality of vanes each slidably inserted in one of the vane grooves of the rotor.

In this type of compressor, the terminal point angle of a suction port or the angle formed by the point at which the outer peripheral surface of the rotor becomes closest to the inner peripheral surface of the cam ring and the terminal point of the suction port (terminal point as viewed in the direction of rotation of the rotor) is equal to the geometrical terminal point angle decided geometrically based on the number of vanes and the number of working chambers (the number of working chambers defined between the rotor and the cam ring when the vanes are not inserted in the rotor).

This type of compressor of the prior art would suffer the disadvantage that it would be impossible to secure a cross-sectional area of suction sufficient for handling a volume of fluid flowing through the suction ports. Thus, the flow velocity of the gas flowing through the suction ports would increase and give rise to the problem that the volumetric efficiency of the compressor is reduced and the discharged gas has an elevated temperature.

SUMMARY OF THE INVENTION

An object of this invention is to provide a slide vane type compressor formed with suction ports having a cross-sectional area large enough to handle a volume of gas flowing through the suction ports without any trouble and capable of minimizing a pressure loss.

Another object is to provide a slide vane type compressor of high volumetric efficiency.

Still another object is to provide a slide vane type compressor formed with suction ports having a suction terminal point angle commensurate with the mean rotational speed of the vanes.

Still another object is to provide a slide vane type compressor capable of avoiding a rise in temperature of discharged gas.

A further object is to provide a slide vane type compressor formed with suction ports of a novel shape for this type of compressor.

In accordance with the invention the suction terminal point angle of a suction port of the slide vane type compressor is greater than a geometrical suction terminal point angle which is geometrically determined when the number of working chambers and the number of vanes are given. The term "suction terminal point angle" of the suction port as used here refers to an angle formed by the position in which the outer peripheral surface of the rotor becomes closest to the inner peripheral surface of the cam ring or a tangential sealing point and the terminal end point of the suction port, as viewed in the direction of the rotor. The term "geometrical suction terminal point angle" as used here refers to the angle formed by the terminal point of the suction port, as viewed in the direction of rotation of the rotor, in a condition in which the suction port is not in communication with a compression chamber of maximum volume defined by two vanes, a rotor, a cam ring and plates disposed on opposite sides of the cam ring and secured thereto and the aforesaid tangential sealing point, with the geometrical suction terminal point angle depending on the number of working chambers (working chambers defined between the rotor and the cam ring with no vanes inserted in the rotor) and the number of vanes inserted in the rotor are given. In a word, the geometrical suction terminal point angle is a suction terminal point angle which satisfies the condition in that the compression chamber defined between the two vanes and having its volume maximized during rotation of the rotor is not in communication with the suction port which has its terminal point angle maximized.

DETAILED DESCRIPTION

Figure 1:
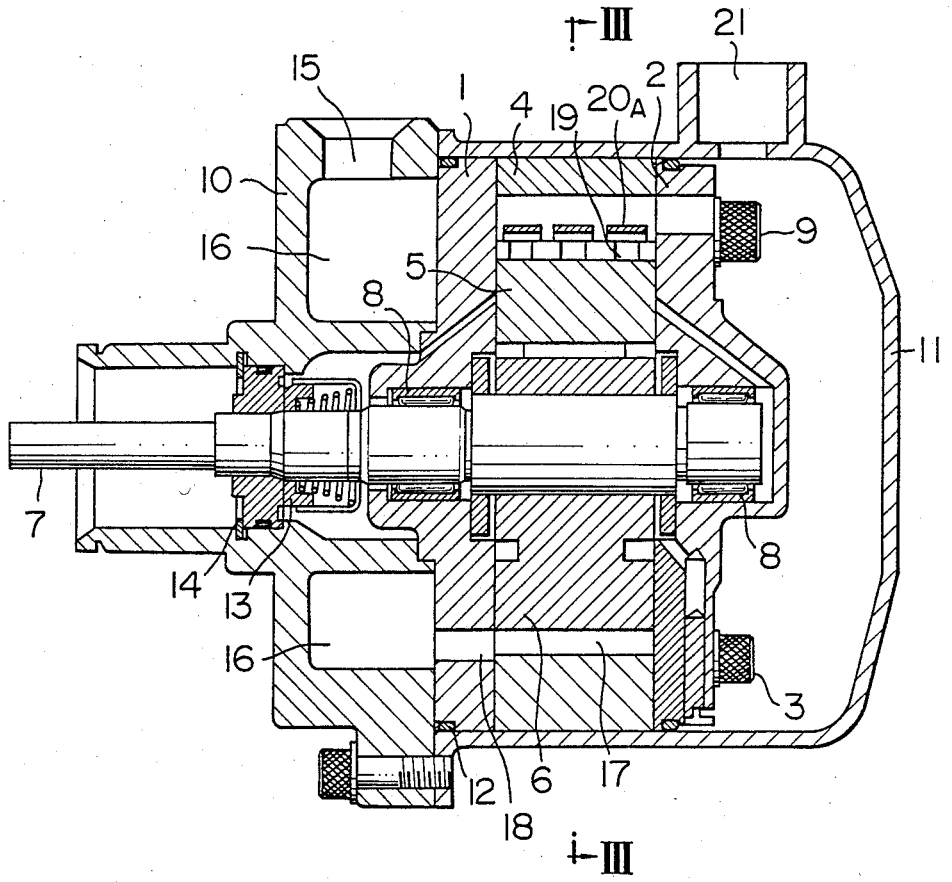
FIG. 1 is a cross-sectional view taken along the line I—I in FIG. 3.
Figure 3:
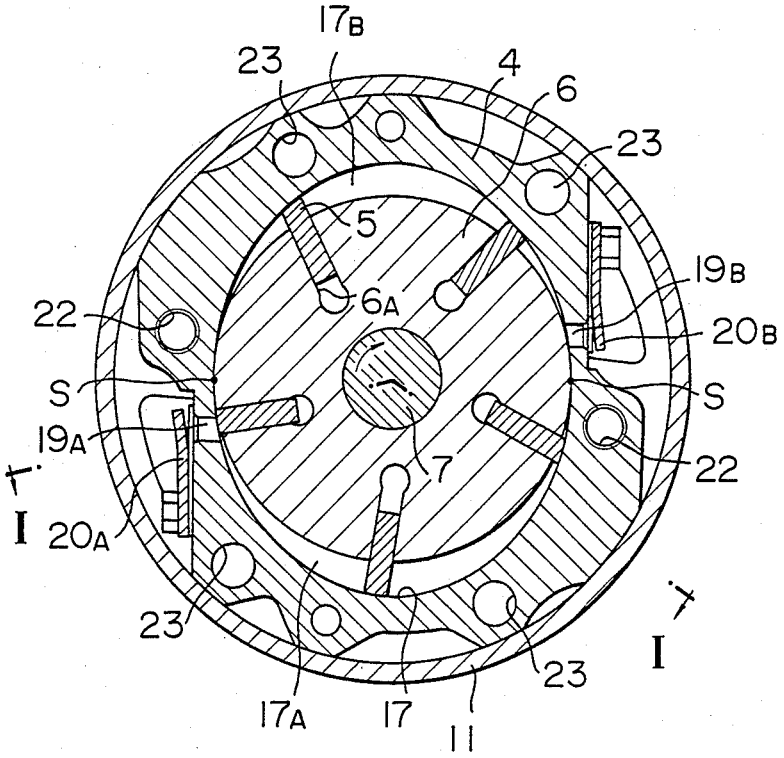
FIG. 3 is a cross-sectional view taken along the line III—III in FIG. 1.

Referring now to the drawings wherein like reference numerals are used throughout the various views to designate like parts and, more particularly, to FIGS. 1 and 3, according to these figures, a slide vane type compressor having two working chambers and five vanes includes a front plate 1 and a rear plate 2 cooperating with a cam ring 4 interposed therebetween and bolted thereto by bolts 3 to define therebetween a space 17, of the elliptic shape in configuration in a cross section at right angles to the axis, for supporting a rotor 6 therein. The rotor 6 has a diameter such that it lightly touches an inner wall surface of the cam ring 4 at two points S or it is spaced apart therefrom with a small clearance therebetween to divide the space 17 into two working chambers 17A and 17B. The rotor 6 is formed with five vane grooves 6A located equiangularly and the rotor 6 is secured to a drive shaft 7 for rotation therewith. Vanes 5 are each inserted in one of the vane grooves 6A for sliding movement substantially radially of the rotor 6.

The drive shaft 7 is journalled by needle bearings 8 mounted on the front plate 1 and rear plate 2 which are bolted to the cam ring 4 by through bolts 9 and these are enclosed by a chamber member 11. A front cover 10 is hermetically connected through an O-ring 12 to the chamber member 11, a rotor 13 is secured to the drive shaft 7, and a cover plate 14 is secured to the front cover 10 provide a shaft seal.

Refrigerant returning from the evaporator of the refrigeration cycle to the compressor is introduced through a suction inlet 15 formed in the front cover 10 into a low pressure chamber 16 formed in the front cover 10. Then the refrigerant flows through suction ports 18 (equal in number to the working chambers, only part of which is shown in FIG. 1, or two in number) formed at the front plate 1 into the working chambers 17A and 17B. As the rotor 6 rotates, the refrigerant is compressed between the two vanes 5 inserted in the vane grooves 6A in the rotor 6, before being discharged from the working chambers through discharge ports 19 (19A and 19B) and discharge valves 20 (20A and 20B) in the cam ring 4 into the chamber member 11 where oil is separated from the refrigerant before the latter is released through a discharge outlet 21 of the compressor to be passed on to the next station in the refrigeration cycle.

Figure 2:
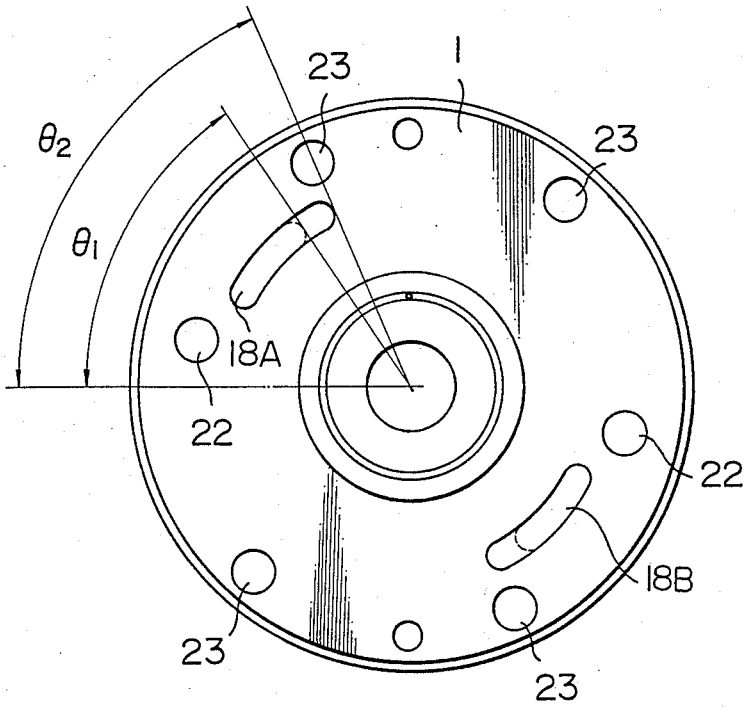
FIG. 2 is an elevational view of a front plate of a compressor constructed in accordance with the present invention.

As shown in FIG. 2, the front plate 1 is formed with two bolt holes 22 for bolting the cam ring 4 thereto and four bolt holes 23 for receiving the through bolts 9 to connect the front and rear plates 1 and 2 and cam ring 4 to the front cover 10. In FIG. 2, the suction ports 18A and 18B usually in the prior art have had a geometrical suction terminal point angle $\theta_1$ which is geometrically determined, in a manner described more fully hereinbelow, to let the terminal point be located in a position in which the volume between the two vanes 5 is maximized.

Figure 4:
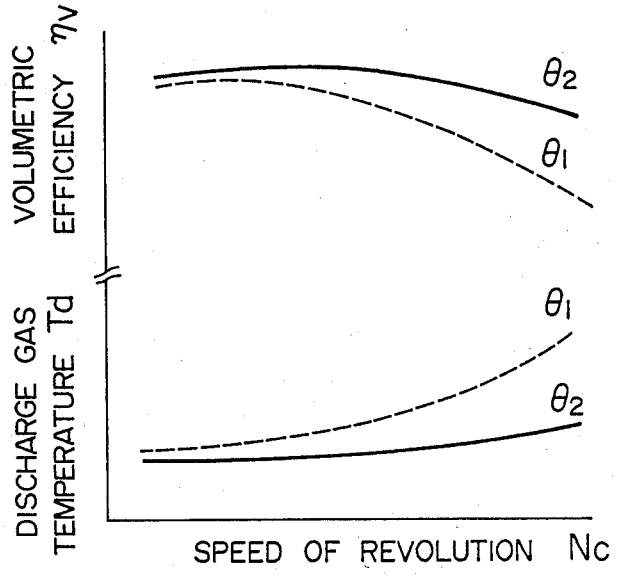
FIG. 4 is a diagrammatic representation of the results of experiments.

FIG. 4 is a diagram showing the results of

Figure 6:
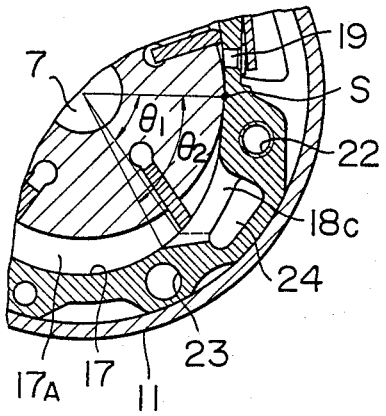
FIG. 6 is a fragmentary sectional view similar to FIG. 3 of portions of the slide vane type compressor comprising a second embodiment of the invention.

Turning to the manner in which the suction terminal point angle is geometrically determined, as apparent from an inspection of FIGS. 2, 3 and 6 of the drawings, when a volume of the compression chamber defined between adjacent two vanes is maximum, the compression chamber is basically, prior to the development of the present invention, isolated from the suction port 18. Under these prior art conditions, a rotation angle of the rotor 6 from the nearest seal point S to the suction terminal point is referred to as a geometrical suction terminal point angle $\theta_1$. As shown in FIG. 2, the suction ports 18A, 18B generally, in the prior art, have a geometrical suction terminal point angle $\theta_1$ which is geometrically determined to permit the terminal point to be located in a position in which the volume between the two vanes 5 is maximized. Thus, assuming that n equals the working chambers or lobes and z represents the number of vanes, with the thickness of the respective vanes being neglected, the angle $\theta_1$ is determined in accordance with the following relationship:

$$\theta_1 = \pi\left(\frac{1}{n} - \frac{1}{z}\right).$$

For example, when the compressor has two working chambers and five vanes as in the case of the embodiment of FIG. 2, $\theta_1 = 54°$, with $\theta_2$ representing an angle obtained by advancing the angle $\theta_1$ by an advance angle $\theta_3$ in a direction of rotation of the rotor 6 clockwise in FIG. 2 or by extending the port. Thus, by advancing the suction terminal point angle of each suction port 18 by the advance angle $\theta_3$ in the direction of rotation of the rotor 6, it is possible to increase the crosssectional area of the port for the refrigerant to flow into the suction ports 18.

As to the advancing of the suction terminal point angle, the term "advance" means to make the suction terminal point angle larger than the geometrically defined angle $\theta_1$. Thus, by employing a suction port 18 having an angle $\theta_2$, the compression chamber is still in communication with the suction port 18 even when the volume of the compression chamber is at a maximum. When the rear vane of the compression chamber reaches the angle $\theta_2$ through further rotation, the compression chamber is then in isolation from the suction port. Under these conditions, a volume $V_{\theta 2}$ of the compression chamber is smaller than the maximum volume $V_o$, thereof, that is:

$$V_{\theta 2}/V_o < 1.$$

FIG. 4 is a diagram showing the results of experiments, particularly the volumetric efficiency $\eta_v$ of the compressor and the discharge gas temperature Td in relation to the speed of revolution Nc of the compressor obtained when the suction ports 18 have suction terminal point angles $\theta_2$ and $\theta_1$. In FIG. 4, a curve represented by $\theta_2$ shows a suction terminal point angle of $\theta_2$, and a curve represented by $\theta_1$ shows a suction terminal point angle of $\theta_1$. As shown in FIG. 4, by changing the suction terminal point angle from $\theta_1$ to $\theta_2$, by the angle $\theta_3$ it is possible to increase the volumetric efficiency $\eta_v$ and lower the discharge gas temperature Td. This tendency becomes more marked when the speed of revolution Nc of the compressor increases. The results of the experiments shown in FIG. 4 show that, by advancing the suction terminal point angle of the suction ports 18 by the advance angle $\theta_3$ in the direction of rotation of the rotor 6, it is possible to greatly reduce a pressure loss that would occur at the suction ports 18.

Figure 5:
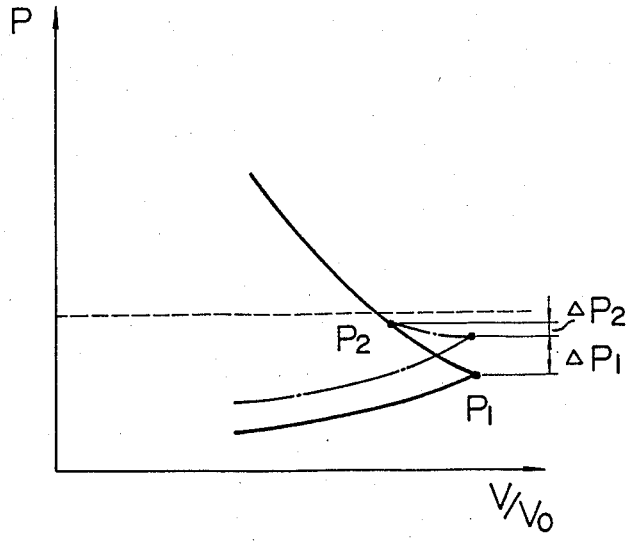
FIG. 5 is an indicator diagram.

FIG. 5 is an indicator diagram showing the compressor proceeding from a suction stroke to a compression stroke with the suction terminal point angle $\theta$ being advanced and not being advanced. In FIG. 5 , V indicates a volume of the compression chamber, $V_o$ indicates the maximum value of V, $P_2$ indicates a pressure at the suction port with an advance angle $\theta_3$ and $P_1$ indicates a pressure with no advanced angle. A horizontal broken line in FIG. 5 indicates a pressure at the suction inlet 15 of the compressor and is the reference pressure, and a chain line indicates a condition in which the suction terminal point angle is advanced. $\Delta P_1$ indicates a reduction in pressure loss at the suction port accounted for by an increase in the cross-sectional area of the suction port due to an advance in the suction terminal point angle thereat. $\Delta P_2$ indicates a reduction in pressure loss accounted for by the compression chamber being maintained in communication with the suction port even if the vane 5 reaches the geometrical suction terminal point angle due to the suction terminal point angle being advanced. Generally influences exerted by pressure loss in the volumetric efficiency and the discharge gas temperature of the compressor are expressed by the following equations (1) and (2):

$$\Delta\eta_v = \eta_v\left(\frac{v_i}{v_s} - 1\right) \quad (1)$$

where $\Delta\eta_v$ is the reduction in volumetric efficiency; $\eta_v$ is the volumetric efficiency of the compressor; $v_i$ is the specific volume of the refrigerant gas flowing through the suction port 18; and $v_s$ is the specific volume of the refrigerant gas at the suction inlet 15 of the compressor; and $$Td = Ts \cdot \left(\frac{Pd}{Pi}\right)^{\frac{K-1}{K}} \quad (2)$$

where Td is the discharge gas temperature of the compressor; Ts is the referigerant gas temperature at the suction inlet 15 of the compressor; Pd is the discharge gas pressure; Pi is the refrigerant gas pressure passing through the suction port 18; and K is the ratio of specific heats. In equation (1), the value of $v_i$ is reduced by $\Delta P_1$ and $\Delta P_2$, so that the value of $\Delta\eta_v$ is reduced. That is, the volumetric efficiency of the compressor increases. In equation (2), assuming that Pd and Ts remain constant, the value of Pi is increased and the value of Td or the discharge gas temperature of the compressor drops due to $\Delta P_1$ and $\Delta P_2$.

In the embodiment described hereinabove, it is possible to reduce a pressure loss at the suction port, thereby enabling the volumetric efficiency of the compressor to increase and the discharged gas thereof to drop in temperature.

The compressor of FIG. 6 has two suction ports of which only one suction port 18C is shown as being formed in the cam ring 4. The refrigerant introduced through the inlet port, not shown, flows through a suction passageway 23 formed in the front plate, not shown, and the cam ring 4 into the suction port 8C formed in the cam ring 4, and flows, after being subjected to suction and compression, through the discharge port 19 into the chamber member, not shown. The suction port 18C has a suction terminal point angle $\theta_2$ which is advanced in the direction rotation of the rotor 6 from the geometrically determined suction terminal point angle $\theta_1$ by an advance angle $\theta_3$. Thus, it is possible to increase the cross-sectional area of the suction port 18C and also to increase the area of the throat (an axially oriented portion defined between the cam ring 4 and the rotor 6 with regard to the suction terminal point angle) of the suction port 18C.

The embodiment of FIG. 6 is capable of increasing not only the area of the suction port but also the area of the throat thereof, thereby enabling a pressure loss in the suction port to be reduced with increased efficiency.

The relationship between the terminal point angle of the suction ports and the mean peripheral velocity of the vanes is discussed more fully hereinbelow.

Generally, in a reciprocating compressor, the suction speed coefficient Ms is defined by the following equation:

$$Ms = \frac{S}{a_o} \cdot \frac{Ap}{Av} \cdot \frac{1}{Cm^s} \quad (3)$$

where $a_o$: the velocity of sound of suction gas;

S: the speed of piston;

Ap: the area of piston;

Av: the area of suction port; and $Cm^s$: the mean flow rate coefficient of suction port.

Figure 7:
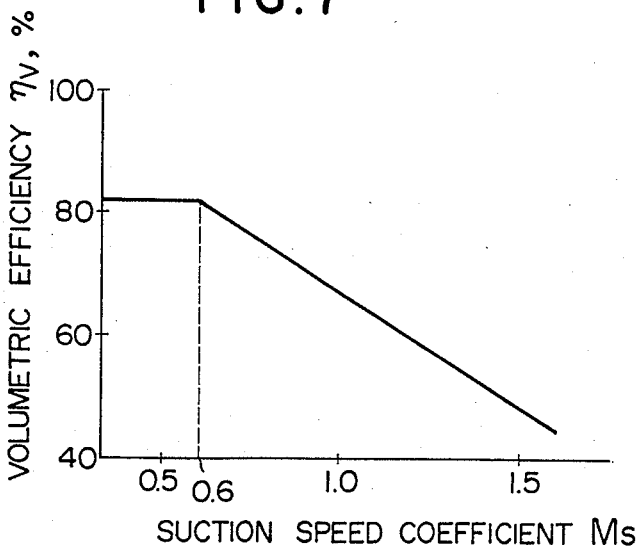
FIG. 7 is a diagrammatic representation of the relationship between the suction speed coefficient Ms and the volumetric efficiency $\eta_v$.

Meanwhile the volumetric efficiency $\eta_v$ of the compressor is as shown in FIG. 7 in which it will be seen that the volumetric efficiency $\eta_v$ is markedly reduced when Ms>0.6. Considering the case of a slide vane type compressor, and assuming that the cam ring profile is $r=a-b\cos 2\theta$ for convenience's sake, then the height $h^s$ of the throat at the suction terminal point angle ($\theta_2$) of the suction port can be expressed as follows:

$$\begin{aligned} h^s &= r(\theta_2) - \text{rotor radius} \\ &= (a - b\cos 2\theta_2) - (a - b) \\ &= b(1 - \cos 2\theta_2). \end{aligned}$$

Also assuming that the cam ring has a width H and the widthwise effective length of the throat is $\frac{1}{2}$H when the refrigerant flows through the throat. Then the throat has a cross-sectional area $\frac{1}{2}H \cdot h^2 = \frac{1}{2}H \cdot b(1-\cos 2\theta_2)$ which is regarded as the cross-sectional area of the suction port.

In the case of a slide vane type compressor, the piston speed is the mean peripheral velocity of the vanes, so that the following relation holds:

$$S = a \cdot \omega$$

where $\omega$: angular velocity.

If the area of the vanes is regarded as the maximum projection of the vanes out of the vane grooves in the case of a vane type compressor, then the following relation holds:

$$Ap = 2b\,H.$$

Thus, equation (3) can be rewritten as follows:

$$Ms = \frac{4\,a\,\omega}{a_o \cdot Cm^s\,(1 - \cos 2\theta_2)}$$

Figure 8:
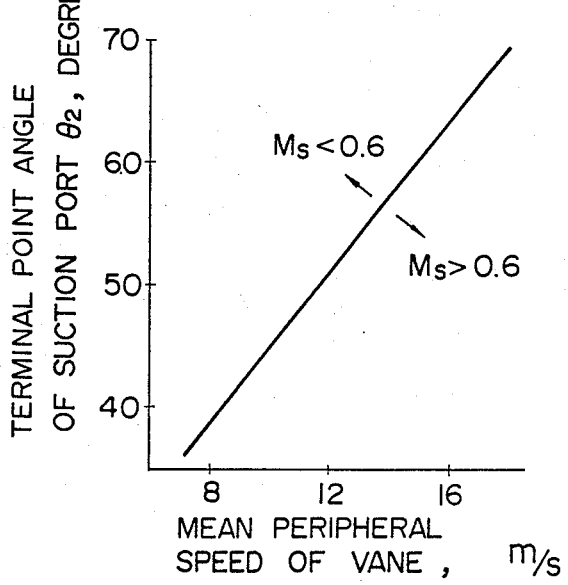
FIG. 8 is a diagrammatic representation of the relationship between the mean peripheral velocity of the vanes and the terminal point angle of the suction port.

FIG. 8 shows the relationship between mean peripheral speed of the vanes and $\theta_2$ for Ms to have a maximum value of 0.6 while no reduction occurs in $\eta_v$ when $Cm^s=0.5$. In FIG. 8, the velocity of sound of suction gas $a_o$ was assumed to be 90 m/s which can be obtained in the refrigerant R-12 at 10° C. As shown in FIG. 8 if the angle $\theta_2$ of the suction terminal point grows bigger, then the range of values of the mean peripheral velocity of the vanes can be increased without a reduction in $\eta_v$. The suction terminal point angle $\theta_1$ decided geometrically grows smaller with a reduction in the number of vanes. Thus the range of values of the mean peripheral velocity in which no reduction occurs in $\eta_v$ is narrowed.

If the advance by the advance angle $\theta_3$ is too great, the capacity of the compressor is reduced.

Figure 9:
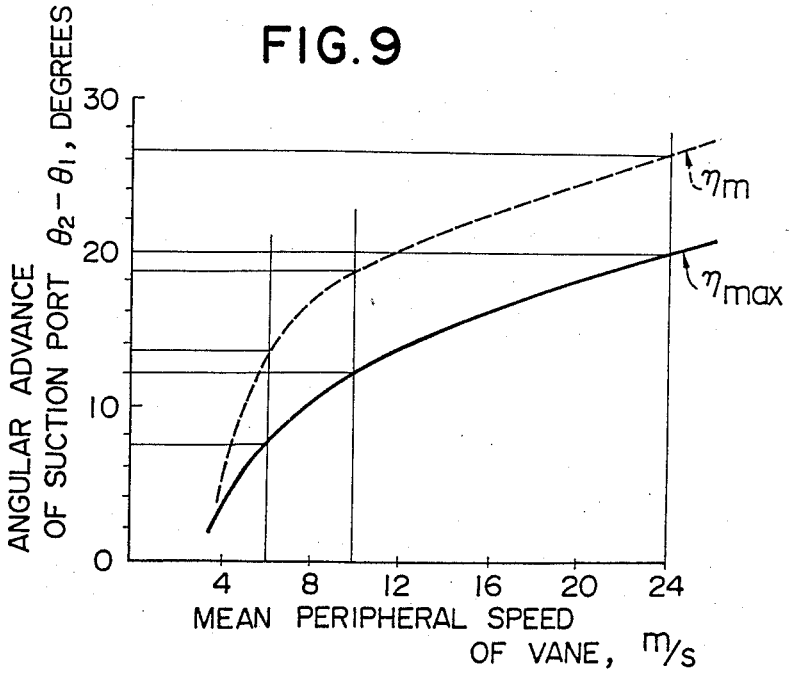
FIG. 9 is a diagrammatic representation of the mean peripheral speed of the vanes and the advance angle.

FIG. 9 provides a diagramatic illustration showing the amount of the advance angle $\theta_3$ in relation to the speed of revolution of the compressor so as to enable a determination of a maximum range of the advance angle $\theta_3$ which would have a practical value. In FIG. 9, the ordinate represents the advance angle $\theta_3$ and the abscissa represents the mean peripheral velocity (m/sec) of the vanes. A solid line $\eta_{max}$ represents the advance angle $\theta_3$ obtained when the ratio $\eta_v/\eta_{vo}$ is maximized, and a broken line $\eta_m$ indicates maximum values of the advance in angle $\theta_3$ obtained when $\eta_v/\eta_{vo}$ becomes larger than unity at each peripheral velocity. $\eta_v$ is the volumetric efficiency achieved with an increase in the suction terminal point of the suction port, and $\eta_{vo}$ is the volumetric efficiency achieved without an increase in the corresponding angle (the suction terminal point angle of the suction port which is decided geometrically).

Meanwhile the mean peripheral velocity of the vanes vary from one type of compressor to another, but compressors usually used for practical purposes have mean peripheral velocities in the range between 6 and 11 m/s.

When all the matters discussed hereinabove are taken into consideration, the range of maximum advances in advance angle $\theta_3$ enabling the ratio $\eta_v/\eta_{vo}$ to become greater than unity at a maximum mean velocity at which the effects achieved by the invention are maximized is as follows:

$$27° \geqq \theta_3 > 0°.$$

Likewise, the range of optimum advances in angle $\theta_3$ enabling the ratio $\eta_v/\eta_{vo}$ to become greater than unity is as follows:

$$20° \geqq \theta_3 > 0°$$

The range of maximum advances in the advance angle $\theta_3$ enabling the ratio $\eta_v/\eta_{vo}$ to become greater than unity at the mean peripheral velocity usually used is as follows:

$$19° \sim 14° > \theta_3 > 0°.$$

Likewise, the range of optimum advances in the advance angle $\theta_3$ enabling the ratio $\eta_v/\eta_{vo}$ to become greater than unity is as follows:

$$12° \sim 8° > \theta_3 > 0°.$$

Table 1 shows the suction terminal point angles of the suction port means incorporating therein the invention. Patterns of the combination of the number of working chambers and the number of vanes selected and shown in the table are typical thereof. It is to be understood, however, that the invention can have application in any other suitable combination of numbers of working chambers and vanes.

TABLE 1

| Combination of Working Chambers and Vanes | One Working chamber - Four Vanes | Two Working Chambers - Four Vanes | Two Working Chambers - Five Vanes |
|---|---|---|---|
| Geometrical Suction Terminal | 90° | 45° | 54° |

TABLE 1-continued

| Combination of Working Chambers and Vanes | One Working chamber - Four Vanes | Two Working Chambers - Four Vanes | Two Working Chambers - Five Vanes |
|---|---|---|---|
| Point Angle Range of Advanced Angle | $27° \geqq \theta_3 > 0°$ | $27° \geqq \theta_3 > 0°$ | $27° \geqq \theta_3 > 0°$ |
| Suction Terminal Point Angle $\theta_2$ of Suction means | $117° \geqq \theta_2 > 90°$ | $72° \geqq \theta_2 > 45°$ | $81° \geqq \theta_2 > 54°$ |

In the first embodiment described hereinabove, the suction ports are formed only at the front plate or the suction ports are axial ports, and in the second embodiment described hereinabove, the suction ports are formed only at the cam ring or they are radial ports. It is to be understood, however, that the invention can have application in compressors formed with both axial and radial ports as suction ports.

In both first and second embodiments, the working chambers are two and the vanes are five in number. However, the invention is not limited to the specific number of working chambers and vanes. The compressors in which the invention can have application are not limited to any number of working chambers and any number of vanes. However, considering practicality, it would be most proper to use any pattern of combination of working chambers and vanes suiting the conditions of use by selecting them from one to three working chambers and two to ten vanes. The most favored patterns of combination consist of one working chamber and four vanes and two working chambers and four vanes for use with compressors.

What is claimed is:

1. A slide vane type compressor comprising:

a cam ring formed with at least one working chamber closed at opposite sides thereof by two plates;

a drive shaft supported for rotation by said plates;

a rotor supported by said drive shaft and having rotary force transmitted therefrom, said rotor being arranged in said at least one working chamber in such a manner that an outer peripheral surface thereof is disposed close to an inner wall surface of said cam ring at least at one axial sealing portion thereof, said rotor being formed with a plurality of vane grooves located equiangularly to one another;

a plurality of vanes each inserted in one of said vane grooves for sliding movement for defining isolated compression chambers;

suction port means for introducing gas therethrough into said at least one working chamber, said suction port means having a suction terminal point angle extending from said axial sealing portion to a terminal point of the suction port means, as viewed in a direction of rotation of the rotor, said suction terminal point angle of said suction port means being greater than a geometrical suction terminal point angle geometrically determined in dependence upon the number of working chambers and the number of vanes so that the suction terminal point angle is advanced as compared with the geometrical suction terminal point angle whereby the suction port means has an effective cross-sectional flow area larger than a suction port means having the geometrical suction terminal point angle; said effective cross-sectional flow area being a minimal cross-sectional area which is defined by the suction port means and the vane positioned at said geometrical suction terminal point angle, said effective cross-sectional flow area of said suction port means becomes larger as said suction terminal point angle is advanced; and discharge port means for discharging said gas from said at least one working chamber after being compressed.

2. A slide vane type compressor as claimed in claim 1, wherein said suction port means comprises radial ports formed in said cam ring, said radial ports extending radially with respect to said at least one working chamber.

3. A slide vane type compressor as claimed in claim 1, wherein at least two working chambers are defined by said rotor, said cam ring and said plates, and wherein at least five vanes are respectively inserted in said vane grooves.

4. A slide vane type compressor as claimed in claim 1, wherein an advance in the suction terminal point angle represented by a difference between the suction terminal point angle of the suction port means denoted by $\theta_2$ and the geometrical suction terminal point angle geometrically determined denoted by $\theta_1$, is set at $\theta_2-\theta_1<27°$.

5. A slide vane type compressor as claimed in claim 4, wherein the advance in the suction terminal point angle of said suction port means is set at $\theta_2-\theta_1<20°$.

6. A slide vane type compressor as claimed in claim 4, wherein the advance in the suction terminal point angle of said suction port means is set at $\theta_2-\theta_1<12°$.

7. A slide vane type compressor as claimed in claim 4, wherein the advance in the suction terminal point angle of said suction port means is set at $\theta_2-\theta_1<8°$.

8. A slide vane type compressor as claimed in claim 1, wherein said suction port means comprises axial ports formed at one of said plates for closing said at least one working chamber of said cam ring, said axial ports extending axially with respect to said at least one working chamber.

9. A slide vane type compressor as claimed in claim 8, wherein at least two working chambers are by said rotor, said cam ring and said plates, and wherein at least five vanes are inserted in said vane grooves.

10. A slide vane type compressor as claimed in claim 8, wherein an advance in the suction terminal point angle represented by a difference between the suction terminal point angle of the suction port means denoted by $\theta_2$ and the geometrical suction terminal point angle geometrically determined denoted by $\theta_1$, is set at $\theta_2-\theta_1<27°$.

11. A slide vane type compressor as claimed in claim 10, wherein the advance in the suction terminal point angle of said suction port means is set at $\theta_2-\theta_1<20°$.

12. A slide vane type compressor as claimed in claim 10, wherein the advance in the suction terminal point angle of said suction port means is set at $\theta_2-\theta_1<12°$.

13. A slide vane type compressor as claimed in claim 10, wherein the advance in the suction terminal point angle of said suction port means is set at $\theta_2-\theta_1<8°$.

* * * * *